US005875728A

United States Patent [19]

Ayers et al.

[11] Patent Number: 5,875,728

[45] Date of Patent: Mar. 2, 1999

[54] SPAR PLATFORM

[75] Inventors: Ray Rolland Ayers, Houston; Donald Wayne Allen, Katy, both of Tex.

[73] Assignee: Shell Oil Company, Houston, Tex.

[21] Appl. No.: 218,488

[22] Filed: Mar. 28, 1994

[51] Int. Cl.[6] ..... B63B 34/44

[52] U.S. Cl. ..... 114/264

[58] Field of Search ..... 114/264, 265, 114/266, 267, 243, 67 R, 67 A

[56] References Cited

U.S. PATENT DOCUMENTS

| | | | |
|---|---|---|---|
| 3,696,325 | 10/1972 | Tauman | 114/243 |
| 3,717,113 | 2/1973 | Wilde | 114/243 |
| 3,884,173 | 5/1975 | Fabula | 114/235 F |
| 4,102,288 | 7/1978 | Berry et al. | 114/264 |
| 4,190,012 | 2/1980 | Rispin et al. | 114/243 |
| 4,398,487 | 8/1983 | Ortloff et al. | 114/243 |
| 4,470,722 | 9/1984 | Gregory | 405/195 |
| 4,474,129 | 10/1984 | Watkins et al. | 114/243 |
| 4,657,116 | 4/1987 | Gardner et al. | 187/1 R |
| 5,214,244 | 5/1993 | Cummings et al. | 174/42 |

OTHER PUBLICATIONS

"Vortex–Induced Motions of Large Floating Structures," Deep Oil Technology Inc., pp. 1, 2 and 11.

"Review and Classification of Various Aerodynamic and Hydrodynamic Means for Suppressing Vortex Shedding," Journal of Wind Engineering and Industrial Aerodynamics, 7, pp. 145–189 (1981).

"Vortex–Excited Vibrations of Cylinders and Cables and Their Suppression," Ocean Engng., vol. 9, No. 2, pp. 135–157 (1982).

"Performance of Segmented Swept and Unswept Cable Fairings at Low Reynolds Numbers," Ocean Engng., vol. 17, No. 4, pp. 393–407 (1990).

*Primary Examiner*—Stephen Avila

[57] ABSTRACT

A spar platform is provided comprising an essentially vertical cylindrical buoyant vessel, and a shroud surrounding the essentially vertical cylindrical vessel wherein the shroud comprises two essentially perpendicular intersecting sets of foam-filled fiberglass elements. In a preferred embodiment, the perpendicular intersecting elements form a grid having openings of 0.05 a dimension of between about 0.05 and about 0.35 vessel diameters and wherein each set of elements contains elements where the centerlines of the elements are separated by about 0.06 to about 0.60 vessel diameters. The shroud is preferably fabricated in panels that can be secured to the vessel using standoffs.

3 Claims, 1 Drawing Sheet

SPAR PLATFORM

FIELD OF THE INVENTION

The present invention relates to a marine spar platform that is subject to reduced levels of vortex induced vibration.

BACKGROUND TO THE INVENTION

Many different types of platforms have been provided for drilling of oil wells offshore. In shallow waters, ridged platforms are most often used. In deeper water spar platforms may be more suitable. A spar platform is a floating vessel that is held at the location by anchor lines. Spar platforms typically have a long vertical cylindrical hull that supports a platform above the water line. When the platform provides space for drilling and maintaining oil or gas wells, the production wells may be provided along the outside edge of the platform or the production wells may be located in the center of the platform with a "moon bay" through the center of the spar.

Designs for spar platforms must consider vortex induced vibrations of the spar hull and may, depending on the prevailing currents and the dimensions and stiffness of the spar, utilize some method to suppress vibrations caused by vortex shedding. Typically, helical strakes have been proposed to suppress vortex induced vibrations. Helical strakes are commonly included on smoke stacks and other vertical cylinders in air to reduce vibrations caused by vortex shedding, but the effectiveness of helical strakes in water, and on shorter cylinders such as spars, is less than what is desired.

A variety of shrouds and fairings have been proposed or used to reduce vibrations caused by shedding of vortices from tubulars in water. These shrouds and fairings may be considerably more effective in reducing vibrations caused by vortex shedding than helical strakes, but are typically difficult and expensive to provide on a tubular as large as the hull of a spar platform.

It is therefore an object of the present invention to provide a spar platform that is less susceptible to vortex induced vibrations than prior art spar platforms. It is a further object to provide such a platform having, over at least a portion of its axial length, a perforated shroud. It is another object to provide such a platform wherein the perforated shroud can be easily installed and is relatively inexpensive.

SUMMARY OF THE INVENTION

These and other objects are achieved by a maine spar platform comprising an essentially vertical cylindrical buoyant vessel, and a shroud surrounding the essentially vertical cylindrical vessel wherein the shroud comprises two essentially perpendicular intersecting sets of foam-filled fiberglass elements. In a preferred embodiment, the perpendicular intersecting elements form a grid having openings of a dimension of between about 0.05 and about 0.35 vessel diameters and wherein each set of elements contains elements where the centerlines of the elements are separated by about 0.06 to about 0.60 vessel diameters. The shroud is preferably fabricated in panels that can be secured to the vessel using standoffs.

The spar platform of the present invention is preferably a oil and/or gas production platform but the floating platform could be one designed for any purpose.

DETAILED DESCRIPTION OF THE INVENTION

Figure 1:
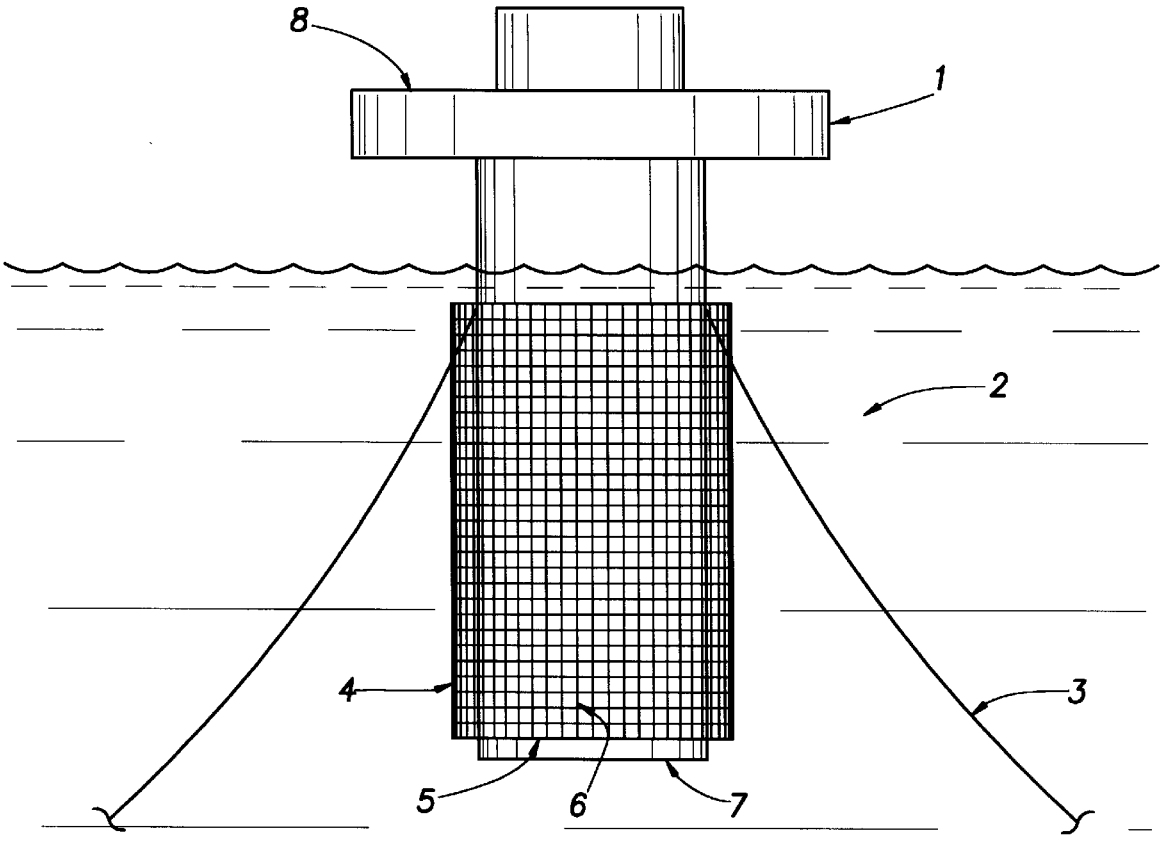
FIG. 1 is a schematic drawing of the spar of the present invention.

Referring now to FIG. 1, a spar platform according to the present invention is shown, 1, floating in a sea, 2, anchored by cables, 3. The spar is a essentially cylindric vessel floating vertically in the water. A shroud, 4, comprising two parallel sets of elements, 5, and 6, are supported about 0.03 to about 0.12 spar diameters from the surface of a spar vessel, 7. The spar vessel provides buoyancy to support a platform, 8, above the surface of the sea. The platform may be used, for example, as a drilling or production platform for the production of oil and gas from subsea reservoirs. A typical oil and gas production spar platform may be thirty to one hundred feet in diameter and three hundred to six hundred feet deep. Risers for drilling, production and export may be placed around the outside of the spar, either inside, outside or as an integral part of the shroud. Alternatively, such risers may be inside a moon bay running through the center of the spar. The shroud does not have to surround the whole spar. Covering only a portion of the spar may provide sufficient vortex induced vibration suppression to be effective. It is preferred that at least 25% of the submerged length of the spar be surrounded by the shroud of the present invention. When currents near the surface are expected to be of higher velocities that deeper currents, providing the shroud of the present invention only around the upper portion of the submerged portion of the spar may be sufficiently effective to reduce vortex induced vibrations.

The elements of the shroud are shown as running vertically and horizontally, but may run in other essentially perpendicular directions. The openings between shroud elements are preferably about 0.05 to about 0.35 spar diameters. The distance between center lines of parallel elements are preferably between about 0.06 and about 0.60. This combination of opening sizes and distance between elements results in a "porous" perforated shroud. By porous, it is meant that the openings in the shroud exceed about 40% of the total area of the shroud (total area including opening area), and preferably more than about 50% of the total area of the shroud. Typical perforated shrouds tested for suppression of vortex induced vibrations of subsea tubulars have been much less "porous." The increased porosity of the preferred shroud of the present invention has been shown to be more effective than a less porous shroud, and also considerably reduces the amount of material required to fabricate the shroud. The more porous shroud is therefore less expensive to fabricate and much easier to attach to the spar.

The shroud of the present invention is preferably attached to the spar vessel by "standoffs" that support the shroud between about 0.03 and about 0.12 spar diameters from the outside of the spar vessel. The shroud may be fabricated in segments of a size that can be fabricated and handled by conventional means. The panels of shroud may be foam polyurethane cores covered with fiberglass, constructed much like pleasure boats are commonly fabricated. Construction of fiberglass covered polyurethane foam would result in the panels being buoyant and therefore not adding to the weight the spar platform must support in the water.

EXAMPLE

The effectiveness of perforated shroud of the present invention to reduce vortex induced vibrations was demonstrated by measurement of vibration amplitudes of a 4.5 inch outside diameter and 4.26 inch inside diameter aluminum pipe in a current tank with and without shrouds according to the present invention. The test pipe had a total length of 4.875 foot total length, of which about 4 foot was submerged in the current tank water and exposed to current. The tube was mounted vertically as a cantilever with the free end pointing downward. The bottom of the pipe was fitted with a ball joint and an eyebolt was attached to the ball joint. The eye bolt was used for placing the pipe in tension. A 0.125 inch diameter wire was attached to the eyebolt in order to place the pipe in tension. Vinyl tape was wrapped around the wire to suppress vibration of the wire. Columbian Model HEVP-14 Biaxial Accelerometers were mounted at the top and bottom of the test pipe inside machined inserts in end caps. The accelerometers were about 4 feet and 10 inches apart.

The perforated shrouds were made from 0.024 inch thick stainless steel plate and then rolled to a five and one half inch inside diameter shroud. Square holes were punched in the plate prior to rolling the plate. Twelve tubes of 0.09375 inch diameter were supported symmetrically around the pipe to model production risers outside of a spar platform. The tubes were spaced from the spar by 0.25 inches.

The pipe was supported from above by a spring having a stiffness of 100 lb/inch with a load cell placed under the spring. Drag on the pipe/shroud combination was measured by providing a horizonal spring having a stiffness of about 50 lb/inch connected to the front of the combination stretched up to about 100 lb force The pipe/shroud combinations were placed in a current tank where water could be circulated in a nearly uniform flow profile. The segment of the current tank in which the pipe/shroud combination was placed was 42 inches wide and about 12 foot deep.

The flow velocity was measured with a Swoffler Model 2100 electromagnetic flowmeter placed about 12 feet downstream of the pipe and off to one side so that it was outside of the cylinder wake but away from the current tank wall. The current was kept at 10.0 feet per second for each test.

Analog voltage signals from the accelerometer were amplified using a Labtech Notebook data acquisition software and stored on a disk drive of a Compaq personal computer. The sampling frequency was 128 Hz. Raw data from the accelerometer was according to the following steps:

1. The raw data was scaled according to the setting on the charge amplifiers and converted to the proper engineering units.

2. The accelerations were Fourier transformed to obtain the inline and the transverse acceleration frequency spectra.

3. The spectra were inverse Fourier transformed to yield acceleration time histories.

4. The filtered accelerations were double integrated using the trapezoidal rule in the time domain to produce displacement time histories.

5. Root mean square (RMS) displacements were computed from the time histories.

Drag coefficients were also measured for each test.

Tests were performed at water velocities of about two to about six feet per second, in increments of about 0.2 feet per second. The Table below summarizes the minimum ratios of the bare pipe rms displacement divided by the rms displacement of the pipe having the shroud. The minimum ratio observed from either the top and bottom accelerometers is reported in the TABLE.

TABLE

| Hole Size (inch) | Porosity (percent) | RF Sway | RF Roll | Cd |
|---|---|---|---|---|
| 0.25 | 32 | 3.28 | 3.18 | 1.22 |
| 0.25 | 44 | 34.81 | 35.53 | 0.95 |
| 0.27 | 66 | 22.28 | 21.53 | 1.05 |
| 0.375 | 36 | 3.74 | 3.64 | 1.13 |
| 0.375 | 44 | 32.76 | 32.67 | 0.94 |
| 0.375 | 56 | 32.76 | 34.24 | 0.97 |
| 0.437 | 76 | 42.85 | 69.32 | 1.00 |
| 0.5 | 25 | 1.75 | 2.69 | 1.29 |
| 0.5 | 32 | 2.99 | 2.71 | 1.44 |
| 0.5 | 44 | 7.74 | 7.62 | 0.97 |
| 0.5 | 52 | 37.13 | 37.39 | 0.91 |
| 0.5 | 64 | 29.32 | 28.42 | 0.89 |
| 0.75 | 32 | 2.77 | 2.98 | 1.19 |
| 0.75 | 44 | 6.63 | 6.52 | 0.98 |
| 0.75 | 56 | 3.36 | 3.50 | 0.96 |
| 0.75 | 64 | 14.28 | 14.00 | 0.90 |
| 0.75 | 73 | 3.69 | 3.24 | 0.97 |
| 0.875 | 54 | 30.76 | 30.89 | 0.96 |
| 0.875 | 76 | 19.21 | 12.92 | 0.89 |
| 1.0 | 79 | 6.26 | 6.03 | 0.95 |

From the TABLE it can be seen that the shrouds each reduce vibrations caused by vortex shedding. Shrouds having greater than about 40% porosity are surprisingly effective in reducing vibrations caused by vortex shedding. The drag coefficients are generally reduced with increased porosity. Increased hole size also generally decreases vortex induced vibrations and decreases the coefficient of drag.

We claim:

1. A marine spar platform comprising an essentially vertical cylindrical buoyant vessel, and a shroud surrounding the essentially vertical cylindrical bouyant vessel wherein the shroud comprises two essentially perpendicular intersecting sets of fiberglass elements and wherein the open area between the fiberglass elements exceeds about 40% of the total area of the total shroud area.

2. The spar platform of claim 1 wherein the perpendicular intersecting elements form a grid having openings of a dimension of between about 0.05 and about 0.35 vessel diameters.

3. The spar platform of claim 1 wherein each set of elements contains elements where the centerlines of the elements are separated by about 0.06 to about 0.60 vessel diameters.

* * * * *